US007306029B2

(12) United States Patent
Dobos

(10) Patent No.: US 7,306,029 B2
(45) Date of Patent: Dec. 11, 2007

(54) TWO PART CONDENSER FOR VARYING THE RATE OF CONDENSING AND RELATED METHOD

(75) Inventor: James G. Dobos, North Augusta, SC (US)

(73) Assignee: Westinghouse Savannah River Company LLC, Aiken, SC (US)

( * ) Notice: Subject to any disclaimer, the term of this patent is extended or adjusted under 35 U.S.C. 154(b) by 156 days.

(21) Appl. No.: 11/259,229

(22) Filed: Oct. 26, 2005

(65) Prior Publication Data

US 2007/0089870 A1 Apr. 26, 2007

(51) Int. Cl.
*F28D 7/10* (2006.01)

(52) U.S. Cl. ..... 165/163; 165/140

(58) Field of Classification Search ..... 165/140, 165/141, 142, 144, 145, 163, 172
See application file for complete search history.

(56) References Cited

U.S. PATENT DOCUMENTS

| | | | | | |
|---|---|---|---|---|---|
| 854,976 | A | * | 5/1907 | Woodcock | 165/140 |
| 1,526,320 | A | * | 2/1925 | Cook | 165/113 |
| 1,799,081 | A | * | 3/1931 | Blomqvist | 165/164 |
| 2,324,707 | A | * | 7/1943 | Johnson | 62/390 |
| 2,425,669 | A | * | 8/1947 | Barrington | 165/111 |
| 2,508,247 | A | | 5/1950 | Giauque | |
| 2,530,798 | A | * | 11/1950 | Arvins et al. | 165/104.31 |
| 3,163,209 | A | * | 12/1964 | Shinn | 165/83 |
| 3,730,229 | A | | 5/1973 | D'Onofrio | |
| 4,061,184 | A | | 12/1977 | Radcliffe | |
| 4,084,546 | A | * | 4/1978 | Schneeberger et al. | 165/140 |
| 4,243,097 | A | | 1/1981 | Vogel | |
| 4,462,463 | A | * | 7/1984 | Gorham, Jr. | 165/140 |
| 4,471,836 | A | | 9/1984 | Hokanson | |
| 4,799,541 | A | | 1/1989 | Buna et al. | |
| 4,865,124 | A | | 9/1989 | Dempsey | |
| 5,046,458 | A | | 9/1991 | Kronich | |
| 5,046,548 | A | * | 9/1991 | Tilly | 165/140 |
| 5,148,861 | A | | 9/1992 | Colvin et al. | |
| 6,047,767 | A | * | 4/2000 | Bodhaine et al. | 165/141 |
| 6,095,240 | A | * | 8/2000 | Hassanein et al. | 165/141 |
| 6,102,106 | A | * | 8/2000 | Manning et al. | 165/76 |
| 6,220,344 | B1 | | 4/2001 | Beykirch et al. | |
| 6,499,534 | B1 | | 12/2002 | Tawney et al. | |
| 6,823,668 | B2 | * | 11/2004 | Endoh et al. | 165/163 |

* cited by examiner

*Primary Examiner*—Teresa J. Walberg
(74) *Attorney, Agent, or Firm*—J. Bennett Mullinax, LLC

(57) ABSTRACT

A heat transfer apparatus, such as a condenser, is provided. The apparatus includes a first component with a first heat transfer element that has first component inlet and outlet ports through which a first fluid may pass. A second component is also included and likewise has a second heat transfer element with second component inlet and outlet ports to pass a second fluid. The first component has a body that can receive a third fluid for heat transfer with the first heat transfer element. The first and second components are releasably attachable with one another so that when attached both the first and second heat transfer elements effect heat transfer with the third fluid. Attachment and removal of the first and second components allows for the heat transfer rate of the apparatus to be varied. An associated method is also provided.

20 Claims, 4 Drawing Sheets

TWO PART CONDENSER FOR VARYING THE RATE OF CONDENSING AND RELATED METHOD

STATEMENT AS TO RIGHTS TO INVENTIONS MADE UNDER FEDERALLY SPONSORED RESEARCH AND DEVELOPMENT

This invention was made with Government support under Contract No. DE-AC09-96-SR18500 awarded by the United States Department of Energy. The Government has certain rights in the invention.

FIELD OF THE INVENTION

The present invention relates generally to a heat transfer apparatus such as a condenser. More particularly, the present invention concerns a two part condenser that has a heat exchange element associated with each of the two parts. The component parts may be used individually or collectively to effect different rates of condensing.

BACKGROUND

Condensers are used in laboratory and industrial settings in order to extract liquid from a gas mixture. Typically, a condenser is employed for condensing vapor from a mixture of condensable and noncondensable gases. In this manner a gas mixture can be broken up into various components. For instance, a gas mixture may contain water in the form of steam along with a certain amount of a noncondensable gas. A condenser may be used in order to convert the steam in the gas mixture into liquid water that can then be drained from the condenser. The resulting noncondensable gas that is in a purer form without the associated steam can then be used for a desired purpose.

Condensers generally include coils through which cold water is pumped. Heat transfer occurs when a warm gas mixture is passed over the cooler coils to result in condensation of one or more of the elements in the gas mixture. The condensation can be collected at the bottom of the condenser while the noncondensable gas is transferred through the top of the condenser to a desired location.

A technician may increase or decrease the flow rate and/or temperature of water that is pumped through the coils if a different rate of condensation is desired. In some instances these types of modifications may not be possible or suitable to attain a desired condensation rate. As an alternative solution, the condenser itself may be replaced with a different condenser that is configured differently in order to render a different rate of condensation. This approach may also be problematic in that the condenser must be disconnected from associated equipment. Replacement of the condenser results in an expenditure of time and effort and requires that the replacement condenser have fittings that are compatible with the associated equipment.

Accordingly, there remains room for variation and improvement within the art.

SUMMARY

Various features and advantages of the invention will be set forth in part in the following description, or may be obvious from the description, or may be learned from practice of the invention.

It is at least one aspect of at least one embodiment of the present invention to provide for a heat transfer apparatus, such as a condenser, that allows a technician to vary the rate of heat transfer. The apparatus includes a first component with a first heat transfer element and a second component with a second heat transfer element. The first component may be capable, by itself, of heating or cooling a fluid by a first heat transfer rate. The first and second components are releasably attachable to one another so that when attached a combined rate of heat transfer is realized through the presence of both the first and second heat transfer elements. The second component may be released from the first component when the combined rate of heat transfer is no longer desired. The ability to attach and remove the components from one another allows the technician to vary the rate of heat transfer without requiring changes in the temperature of the first and second heat transfer elements. Further, the components may be attached and removed from one another without having to completely detach associated equipment.

Another aspect of an embodiment of the present invention exists in which the first heat transfer member may include a plurality of coils that form a passageway. The second heat transfer member may also have a plurality of coils that are sized to fit into the passageway formed by the coils of the first heat transfer member when the first and second components are attached to one another. The first and second components can also include tubes that are placed into communication with one another when the two components are attached. The fluid that is heated or cooled may flow through the tubes and over the coils in order to effect heat transfer.

Various exemplary embodiments of the invention exist in which attachment of the first and second components can be accomplished in a number of manners. For example, the second component may include a male fitting that is received into a female fitting of the first component. A connecting cap is included on the second component and has internal threading that engages external threading on the female fitting of the first component. The technician tightens the connecting cap in order to attach the first and second components and can loosen the connecting cap when disengagement is desired.

The first and second components may be configured to be heat transfer devices that can operate independently of one another in accordance with other aspects of the present invention. For example, the first component can include a tube that surrounds coils of the first heat transfer element so that a fluid inside of the tube can be cooled and condensed. The second component may function as a coldfinger type condenser and have a plurality of coils that are outside of a tube. The first and second components can be attached to one another so that a combined rate of heat transfer is realized though the presence of both the first and second heat transfers elements.

It is yet another aspect of at least one embodiment of the present invention to provide for a condenser that has a first component with a first heat transfer element. The first heat transfer element includes a plurality of coils in communication with a first component inlet port and a first component outlet port configured to allow a fluid to pass through the first heat transfer element. The first component has a tube that surrounds the coils of the first heat transfer element. The first heat transfer element is configured to cool gas present in the tube to cause condensation. A second component with a second heat transfer element that has a plurality of coils in communication with a second component inlet port and a second component outlet port is also present. The second component inlet and outlet ports allow a fluid to pass through the coils of the second heat transfer element. The first and second components are releasably attachable to one another. At least some of the coils of the second heat transfer element are positioned in a passageway defined by the coils of the first heat transfer element when the first and second components are attached. The first and second heat transfer elements act to cool gas present in the tube to cause condensation.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
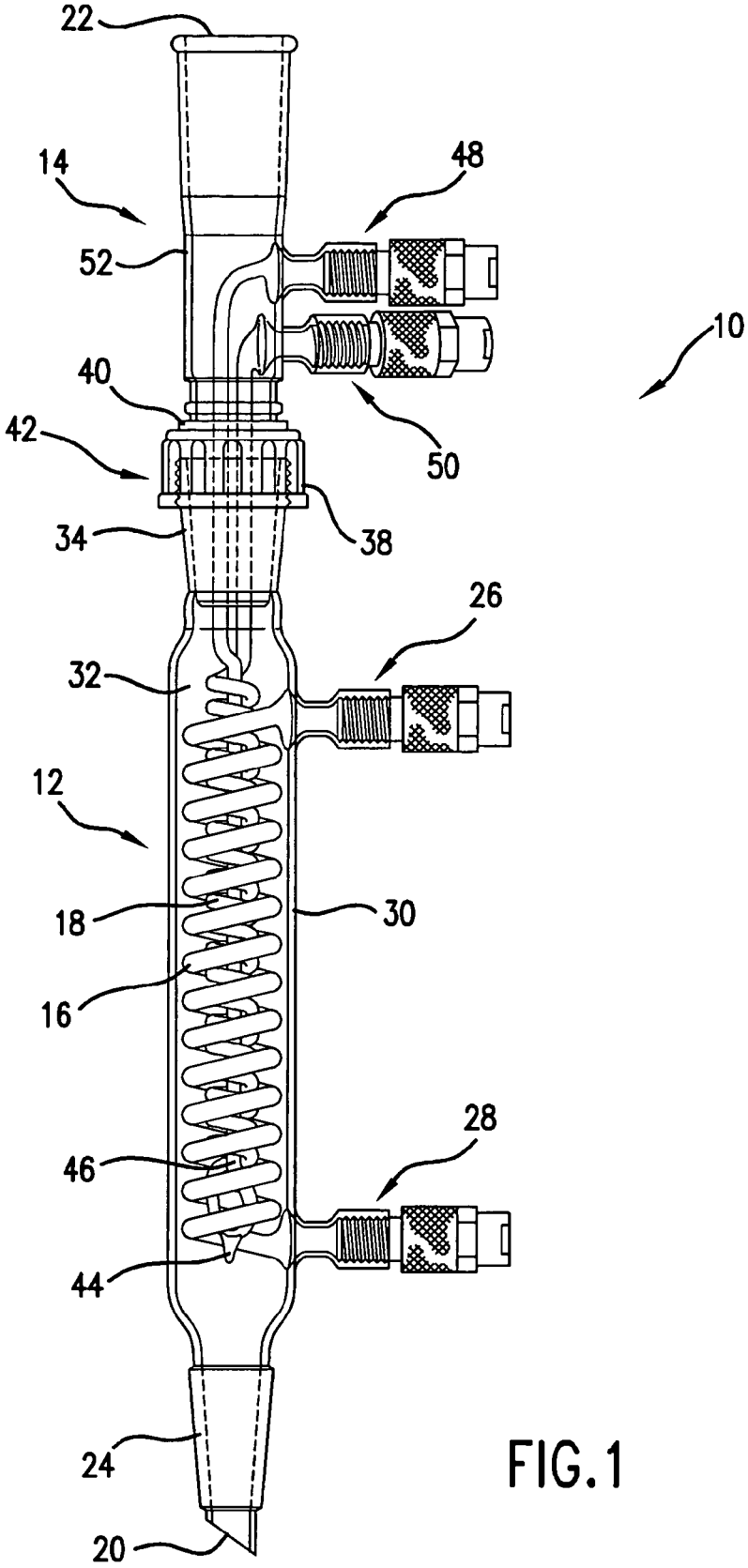
FIG. 1 is a front view of a condenser that includes a first component connected to a second component in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to about 7 also includes a limit of up to about 5, up to about 3, and up to about 4.5.

The present invention provides for a heat transfer apparatus, described for sake of example as a condenser 10, that is made of a first component 12 and a second component 14. The condenser 10 functions in order to condense steam or other condensable vapor from a gas mixture. The first and second components 12 and 14 are configured for releasable attachment with one another so that they can be attached and detached by a technician with minimal effort. Each of the components 12 and 14 has a heat transfer element 16 and 18 to provide cooling for condensation. The first component 12 is configured as a fully functional condenser to condense at a desired rate. The second component 14 may be connected to the first component 12 so that additional condensation ability, as afforded by the second heat transfer element 18, is incorporated into the combined condenser 10. The first and second components 12 and 14 can be used separately or together with one another to give the technician flexibility in selecting a rate of heat transfer.

Figure 2:
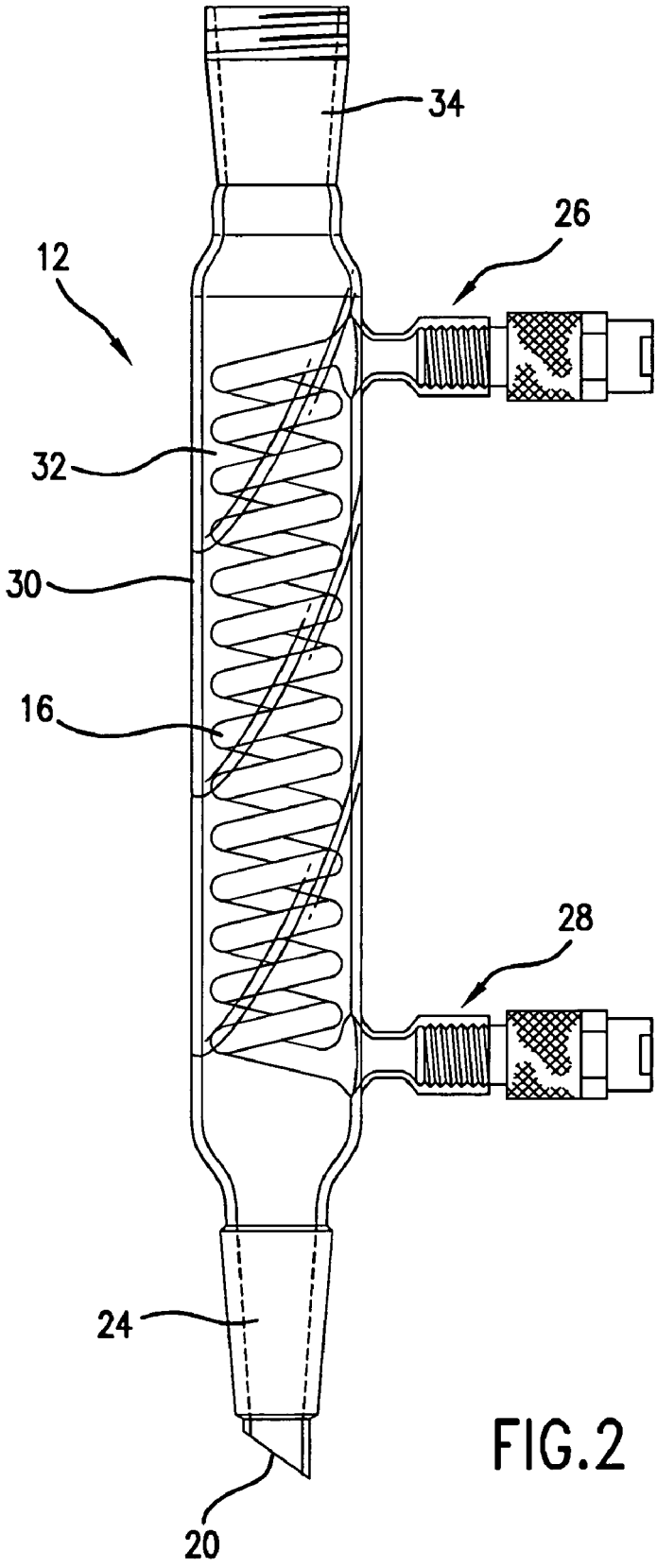
FIG. 2 is a front view of the first component of FIG. 1 disconnected from the second component.

FIG. 1 is a front view of the condenser 10 in which the first component 12 and the second component 14 are attached to one another. FIG. 2 shows the first component 12 disconnected from the second component 14 with an inlet 20 on one end. The inlet 20 receives a gas mixture from a heated flask, passageway or vessel (not shown). The tube 30 may be 38 millimeter standard wall tubing in accordance with one exemplary embodiment. It is to be understood that the condenser 10 including the tube 30 may be variously sized in other exemplary embodiments. For example, the tube 30 may have a diameter of up to 70 millimeters. A male fitting 24 is included at the inlet 20 to aid in attachment to the source of the gas mixture. The inlet 20 may be configured in any manner commonly known in the art. For example, the inlet 20 could be a standard 20/40 drip joint configured to mate with a standard 24/40 outer joint in accordance with one exemplary embodiment. The inlet 20 may be arranged so that condensate exiting the inlet 20 from the tube 30 exits from one side of the inlet 20.

The first component 12 includes a first heat transfer element 16 that forms a plurality of coils through which a liquid or gas may be passed. The coils of the first heat transfer element 16 may be attached to, or spaced a distance from, the inner wall of the tube 30. The coils of the first heat transfer element 16 define a passageway 32 therethrough for receipt of a second heat transfer element 18 of the second component 14 as will be momentarily discussed. A fluid, such as water, may be introduced into the first heat transfer element 16 from a first component inlet port 28. A desired amount of pressure can be applied in order to transport the water out of the first heat transfer element 16 by way of a first component outlet port 26. The ports 26 and 28 may be configured in any commonly known manner in order to provide fluid communication between the coils of the first heat transfer element 16 and a water source. For example, the ports 26 and 28 may be standard #7 internal screw thread connectors in accordance with one exemplary embodiment.

A gas mixture can be introduced into the first component 12 through the inlet 20. The gas mixture will then pass through the tube 30 while being cooled by cooler water that is transferred through the coils of the first heat transfer element 16. Heat is then transferred out of the gas mixture by conduction, convection, or a combination of the two and into the coils of the first heat transfer element 16. Cooling of the gas mixture causes steam in the gas mixture to condense into a liquid form in the tube 30. The temperature and/or rate of water passed through the first heat transfer element 16 may be modified in order to change the rate of heat transfer and resulting rate of condensation. The condensate may then exit the first component 12 through the inlet 20. Alternatively, the first component 12 may be configured so that a drainage outlet separate from the inlet 20 is present for the removal of condensate. Noncondensable gas that is in a purer form without the associated condensed steam can be removed from the tube 30 by way of a female fitting 34 after passing across the first heat transfer element 16.

Figure 3:
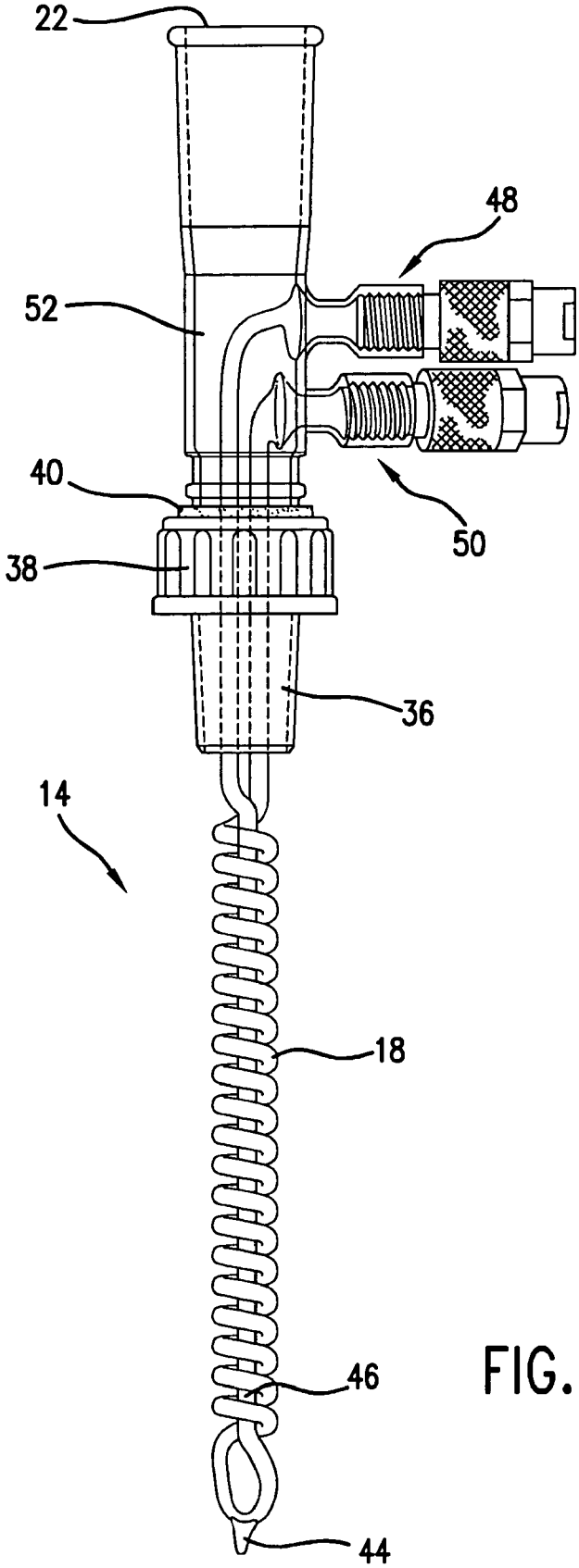
FIG. 3 is a front view of the second component of FIG. 1 disconnected from the first component.

FIG. 3 shows the second component 14. A second heat transfer element 18 is present and includes a series of coils that end in a tip 44 that loops around and back into a linear segment 46 that extends back through an interior passageway formed by the coils. The linear segment 46 is in communication with a second component inlet port 48 through which a fluid, such as water, may be introduced into the second heat transfer element 18. Water can be transferred through the linear segment 46 and coils to exit the second heat transfer element 18 through a second component outlet port 50. As previously discussed in relation to ports 26 and 28, the ports 48 and 50 can be configured in any known manner and may be, for instance, standard #7 internal screw thread connectors in accordance with one exemplary embodiment.

The second heat transfer element 18 is sized and shaped so as to be received into the passageway 32 of the first heat transfer element 16. This arrangement is shown in FIG. 1. Incorporation of the first and second components 12 and 14 with one another allows for an enhanced degree of heat transfer and resulting condensation to be realized. Here, the second heat transfer element 18 in addition to the first heat transfer element 16 is used to draw condensate from the gas mixture. The tip 44 of the second heat transfer element 18 extends past the coils of the first heat transfer element 16 in accordance with certain exemplary embodiments in order to assist in the drainage of condensate from the tube 30. However, it is to be understood that the tip 44 could be contained within the coils of the first heat transfer element 16 if desired. The first and second heat transfer elements 16 and 18 form a double coil arrangement when assembled so that only a space may be present between the two sets of coils. Additionally, the linear segment 46 extends through the center of the two sets of coils in the resulting combination. The coils and linear segment 46 are arranged in order to allow for gas to flow through the inlet 20 and female fitting 34. In accordance with one exemplary embodiment, the temperature of the gas mixture can be increased 10°-15° Celsius while still maintaining the same rate of condensing when using both the first and second components 12 and 14 instead of the first component 12 alone.

A connection 42 may be used in order to attach the first and second components 12 and 14 to one another. The connection 42 may be configured in a variety of manners. For example, the connection 42 may be a Rodaviss® ground joint connection provided by Kimble/Kontes of Vineland, N.J. The female fitting 34 is provided with external threading thereon. In accordance with one exemplary embodiment, the female fitting 34 is a 24/40 Rodaviss® outer fitting. A male fitting 36 on the second component 14 is received by the female fitting 34. The male fitting 36 may be configured in a variety of manners. For example, the male fitting 36 is a 24/40 Rodaviss® inner fitting in accordance with one exemplary embodiment. A connecting cap 38 is provided on the second component 14 and has internal threading thereon that mate with the external threading on the female fitting 34. A technician may maneuver the second component 14 into the first component 12 until the male fitting 36 is inserted into the female fitting 34. The technician may rotate and tighten the connecting cap 38 until the connection 42 between the first and second components 12 and 14 is formed. The connecting cap 38 allows the connection 42 to be formed without requiring the components 12 and 14 to rotate relative to one another. An O-ring 40 is incorporated into the connection 42 to prevent leakage of fluid from the inside of condenser 10 from escaping through the connecting cap 38.

Connection and removal of the first and second components 12 and 14 can each be accomplished in a single step by the technician. The technician simply inserts the second component 14 into the first component 12 and tightens the connecting cap 38 until a suitable connection is established. For removal, the technician loosens the connecting cap 38 and pulls the components 12 and 14 apart. The condenser 10 thus provides an easy and fast way of varying the heat transfer/condensing rate in order to save time and effort. Although described as employing a threaded connection 42, it is to be understood that other arrangements are possible. For example, the first component and second component may be friction fit or attached by mechanical fasteners to one another.

Referring back to FIG. 3, the second component 14 has a tube 52 through which the noncondensable gas flows after being cooled by the heat transfer elements 16 and 18. In this regard, the tube 52 is in fluid communication with the tube 30 to receive the noncondensable gas. An outlet 22 is present on one end of the second heat transfer element 18 and is in fluid communication with the tube 52. The outlet 22 can be constructed in a variety of manners. For example, the outlet 22 is a 24/40 outer fitting in one exemplary embodiment. A receptacle can be placed into fluid communication with the outlet 22 in order to receive the noncondensable gas from the second component 14. Alternatively, the outlet 22 may simply vent the noncondensable gas to the environment in particular applications. Although designed for use with the condenser 10, the second component 14 has separate utility in that it may be used as a coldfinger type condenser if desired.

The tube 52 is generally sized so as to be of a shorter length than the tube 30. The tube 52 may be from 2-6 inches in length, and in particular 2¾ inches in length, in accordance with various exemplary embodiments. The tube 30 may be from 4-18 inches in length, and in particular 8 inches in length, in accordance with other exemplary embodiments. The tubes 30 and 52 along with the heat transfer elements 16 and 18 may be made of glass. It is to be understood, however, that other materials can be used in construction of the various parts of the condenser 10.

The condenser 10 gives the technician greater flexibility in selecting different heat transfer/condensing rates. The first component 12 can be connected to a source of supply gas mixture and can condense steam or other condensable gas from the mixture at a particular rate. The second component 14 can then be incorporated into and attached to the first component 12 without having to disconnect the source of supply gas mixture from the first component 12. Incorporation of the second component 14 causes an increase in the heat transfer/condensing rate due to the presence of an additional heat transfer element 18. Alternatively, variation in the heat transfer/condensing rate can be realized by keeping the first and second components 12, 14 incorporated into one another. For instance, the flow of water through the first heat transfer element 16 may be shut off while the flow of water through the second heat transfer element 18 continues in order to result in a decreased heat transfer/condensing rate. Additionally or alternatively, the temperature and/or the rate of water flow through the heat transfer elements 16 and 18 can be modified in order to achieve a desired heat transfer/condensing rate.

Although described as condensing steam from a gas mixture, it is to be understood that the condenser 10 may be used to condense other types of elements, substances, and mixtures besides water. Further, in some applications the condenser 10 may be used for heating instead of cooling the gas mixture.

EXPERIMENT CARRIED OUT IN ACCORDANCE WITH ONE EXEMPLARY EMBODIMENT

An experiment was carried out in accordance with one exemplary embodiment of the present invention in order to demonstrate an improved rate of condensation when using both the first and second components 12 and 14. Measurements were taken when using only the first component 12 and are shown below as Table 1:

| Time (minutes/seconds) | Temperature (Degrees Celsius) |
|---|---|
| 0/0 | 26.2 |
| 1/0 | 27.1 |
| 2/0 | 31.2 |
| 3/0 | 36.2 |
| 4/0 | 42.3 |
| 5/0 | 48.3 |
| 6/30 | 58.3 |
| 7/30 | 64.6 |
| 8/30 | 71.2 |
| 9/30 | 77.7 |
| 11/0 | 86.5 |
| 12/0 | 91.7 |
| 13/25 | 100.0 |

At 32 minutes and 25 seconds the test was stopped and the amount of condensation was measured to be 26.0 milliliters. The second component 14 was then attached to the first component 12 and the procedure was rerun in order to see if an increased rate of condensing occurred. The results are shown below as Table 2:

| Time (minutes/seconds) | Temperature (Degrees Celsius) |
|---|---|
| 0/0 | 22.8 |
| 1/0 | 23.7 |
| 2/0 | 28.5 |
| 2/30 | 31.1 |
| 3/0 | 34.0 |
| 3/30 | 36.7 |
| 4/0 | 40.2 |
| 5/0 | 47.2 |
| 5/30 | 50.2 |
| 6/0 | 54.5 |
| 6/30 | 57.5 |
| 7/0 | 61.5 |
| 8/0 | 68.7 |
| 9/0 | 75.3 |
| 9/30 | 79.0 |
| 10/30 | 85.5 |
| 11/15 | 89.9 |
| 12/15 | 95.2 |
| 12/25 | 96.5 |
| 13/0 | 99.0 |
| 13/3 | 100.0 |

At 32 minutes and 25 seconds the test was stopped and the amount of condensation was measured to be 30.8 milliliters. Therefore, addition of the second component 14 to the first component 12 resulted in an increase in the rate of condensation.

An additional experiment was carried out in accordance with one exemplary embodiment of the present invention. Here, water was transferred through the first heat transfer element 16 and cooling data, without the presence of the second heat transfer element 18, was obtained. The results to cool air using only the first component 12 are shown below as Table 3:

| Flow Rate (milliliters per minute) | Temperature of water out (Celsius) | | Heat Transfer Rate (calories per minute) | Temperature of air out (Celsius) |
|---|---|---|---|---|
| 470 | 26.5 | 3.7 | 1739 | 30 |
| 650 | 24.9 | 2.1 | 1365 | 28.2 |
| 660 | 25.3 | 2.5 | 1650 | |
| 860 | 24 | 1.2 | 1032 | |
| 1050 | 23.8 | 1 | 1050 | |

The second component 14 was then attached to the first component 12 in order to provide additional cooling of the air by use of water flowing through the second heat transfer element 18. The cooling results using both the first and second components 12 and 14 are shown below as Table 4:

| Flow Rate (milliliters per minute) | Temperature of water out (Celsius) | | Heat Transfer Rate (calories per minute) | Temperature of air out (Celsius) |
|---|---|---|---|---|
| 470 | 26.4 | 3.6 | 1692 | 21.6 |
| 540 | 25.2 | 2.4 | 1296 | 20.2 |
| 620 | 25.1 | 2.3 | 1426 | |
| 650 | 24.8 | 2 | 1300 | |
| 900 | 24.2 | 1.4 | 1260 | |
| 980 | 24 | 1.2 | 1176 | |

Figure 4:
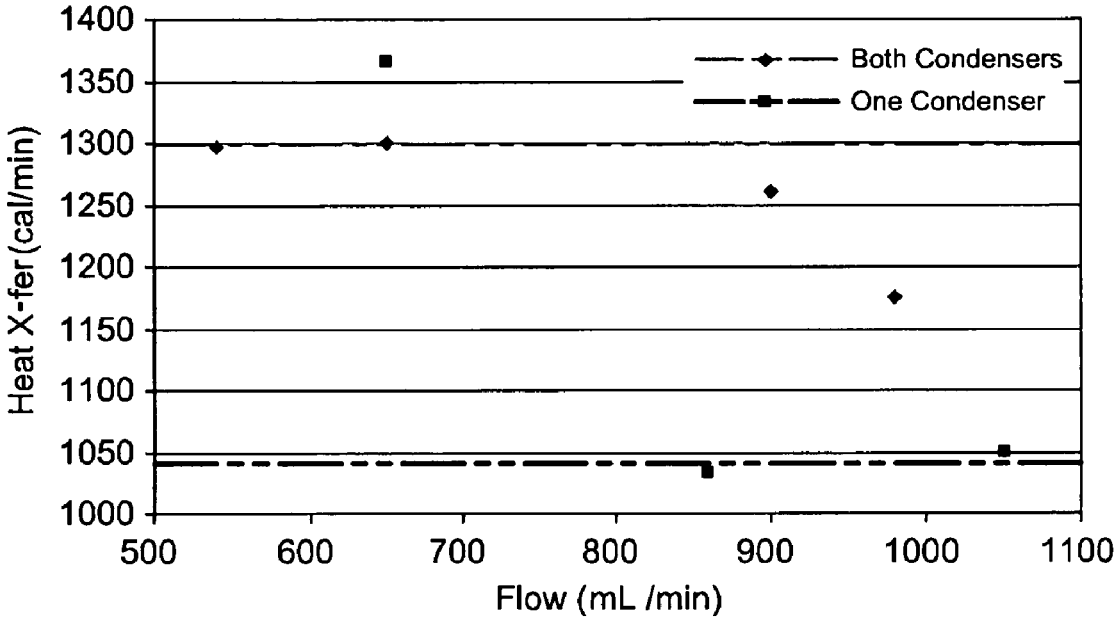
FIG. 4 is a chart of test data taken in accordance with an experiment carried out in accordance with one exemplary embodiment of the invention.

A plot of some of the data points in Tables 3 and 4 are shown in FIG. 4 to compare heat transfer rates when using the first component 12 versus the combination of the first and second components 12 and 14. As shown, the first component 12 alone cools at a rate of approximately 1050 calories per minute. The combination of the first and second components 12 and 14 produce a resultant cooling rate of approximately 1300 calories per minute. The difference of approximately 250 calories per minute between the two results in an increase in cooling of approximately 24%.

At larger flow rates, greater than around 900 milliliters per minute, the heat transfer rate of the combination of the first and second components 12 and 14 drops off. This drop off may be due simply to flow constraints within the first and second heat transfer elements 16 and 18 that require increased pressures to achieve increased flow rates. One way to increase the heat transfer rate at higher flow rates may be to increase the diameter of the coils of the first and second heat transfer elements 16 and 18 so as to require less pressure.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A condenser, comprising:

a first component having a first heat transfer element with a plurality of coils in communication with a first component inlet port and a first component outlet port configured to allow a fluid to pass through said coils of said first heat transfer element, said first component having a tube surrounding said coils of said first heat transfer element, wherein said first heat transfer element is configured to cool gas present in said tube to cause condensation; and a second component having a second heat transfer element with a plurality of coils in communication with a second component inlet port and a second component outlet port configured to allow a fluid to pass through said coils of said second heat transfer element;

wherein said first component and said second component are releasably attachable to one another such that when attached at least some of said coils of said second heat transfer element are positioned in a passageway defined by said coils of said first heat transfer element such that both said first and second heat transfer elements are configured to cool gas present in said tube to cause condensation, and when detached at least some of said coils of said second heat transfer element are capable of being removed from said passageway defined by said coils of said first heat transfer element.

2. The condenser as in claim 1, wherein said second component has a connecting cap with internal threads that are configured to engage external threads located on said first component in order to effect attachment of said first and second components.

3. The condenser as in claim 1, wherein said second heat transfer element has a linear segment located in a passageway defined by said coils of said second heat transfer element, and wherein said second heat transfer element has a tip disposed between and placing said linear segment and said coils of said second heat transfer element into communication with one another.

4. The condenser as in claim 1, wherein said second component has a tube that is placed into communication with said tube of said first component when said first and second components are attached to one another.

5. The condenser as in claim 1, wherein:

said first component is configured to cool gas present in said tube to cause condensation when unattached to said second component; and wherein said second component is configured to operate as a coldfinger type condenser when unattached to said first component.

6. The condenser as in claim 1, wherein:

said first component has a female fitting located on one end thereof;

wherein said second component has a male fitting that surrounds at least a portion of said second heat transfer element; and wherein said female fitting and said male fitting engage one another when said first and second components are attached.

7. The heat transfer apparatus as in claim 1, wherein:

said first component has a tube that surrounds at least a portion of said first heat transfer element;

wherein said second component has a tube that is placed into communication with said tube of said first component when said first and second components are attached to one another;

wherein said tubes of said first and second components are configured to allow the third fluid to pass through when said first and second components are attached to one another.

8. A heat transfer apparatus for effecting heat transfer with a third fluid, comprising:

a first component having a first heat transfer element with a first component inlet port and a first component outlet port configured to allow a first fluid to pass through said first heat transfer element, wherein said first component has a body configured to receive and allow to pass through a third fluid for heat transfer with said first heat transfer element; and a second component having a second heat transfer element with a second component inlet port and a second component outlet port configured to allow a second fluid to pass through said second heat transfer element;

wherein said first and second components are releasably attachable with one another and are configured such that when attached said first and second heat transfer elements both act to effect heat transfer with the third fluid, and are configured such that when detached said first heat transfer element is capable of effecting heat transfer with the third fluid passing through said body.

9. The heat transfer apparatus as in claim 8, wherein:

the first and second fluids are water, and wherein the third fluid is a gas mixture;

wherein the first fluid is in isolation from the second fluid when passing through said first heat transfer element between said first component inlet port and said first component outlet port.

10. The heat transfer apparatus as in claim 8, wherein:

said body has a tube and wherein said first heat transfer member has a plurality of coils located in said tube that define a passageway;

wherein said second heat transfer member has a plurality of coils that are disposed in said passageway formed by said coils of said first heat transfer member when said first and second components are attached to one another.

11. The heat transfer apparatus as in claim 8, wherein said first and second components are rendered releasably attachable with one another by way of a connection that includes a connecting cap on said second component with internal threads that are configured to engage external threads located on said first component.

12. The heat transfer apparatus as in claim 8, wherein the third fluid includes steam and wherein said first and second heat transfer elements cool the third fluid so as to condense steam from the third fluid.

13. The heat transfer apparatus as in claim 8, wherein:

said first component has a female fitting located on one end thereof;

wherein said second component has a male fitting that surrounds at least a portion of said second heat transfer element; and wherein said female fitting and said male fitting engage one another when said first and second components are attached.

14. A method of varying the heat transfer rate of a heat transfer apparatus, comprising the steps of:

providing a first component with a first heat transfer element having a first component inlet port and a first component outlet port configured to allow a first fluid to pass through said first heat transfer element;

providing a second component with a second heat transfer element having a second component inlet port and a second component outlet port configured to allow a second fluid to pass through said second heat transfer element;

attaching said first and second components to one another;

transferring a first fluid through said first heat transfer element and transferring a second fluid through said second heat transfer element such that said first and second heat transfer elements render a combined heat transfer rate;

removing said first and second components from one another such that said first and second heat transfer elements do not render the combined heat transfer rate; and transferring a first fluid through said first heat transfer element such that said first heat transfer element renders a first heat transfer rate.

15. The method as in claim 14, wherein:

said first heat transfer element has a plurality of coils that define a passageway;

wherein said second heat transfer element has a plurality of coils; and wherein said attaching step includes positioning at least some of said coils of said second heat transfer element into said passageway defined by said coils of said first heat transfer element.

16. The method as in claim 14, wherein:

said first component has a female fitting;

wherein said second component has a male fitting; and wherein said attaching step includes inserting said male fitting of said second component into said female fitting of said first component.

17. The method as in claim 14, wherein:

said second component has a connecting cap;

wherein said attaching step includes engaging internal threading on said connecting cap with external threading on said first component; and wherein said removing step includes disengaging said internal threading on said connecting cap from said external threading on said first component.

18. The method as in claim 14, wherein:

said first component has a tube;

wherein said second component has a tube; and wherein said attaching step includes placing said tube of said first component into communication with said tube of said second component.

19. The method as in claim 14, further comprising the steps of:

introducing a third fluid into said first component when said first and second components are attached to one another; and cooling said third fluid by said first and second heat transfer elements wherein said first and second fluids are cooler than said third fluid such that condensate is formed.

20. The method as in claim 14, wherein:

said first component has a tube, a male fitting, and a connecting cap with internal threading;

wherein said second component has a tube and a female fitting with external threading thereon; and wherein said attaching step includes inserting said male fitting into said female fitting and engaging said internal threading on said connecting cap with said external threading on said first component so as to attach said first and second components to one another and place said tube of said first component into communication with said tube of said second component.

* * * * *